United States Patent [19]

Arfert

[11] 4,054,229

[45] Oct. 18, 1977

[54] CONTAINER

[75] Inventor: Horst F. W. Arfert, Richmond, Va.

[73] Assignee: Reynolds Metals Company, Richmond, Va.

[21] Appl. No.: 657,386

[22] Filed: Feb. 11, 1976

[51] Int. Cl.[2] ..... B65D 41/10

[52] U.S. Cl. ..... 220/288; 206/515; 215/318; 220/289; 220/304; 220/355

[58] Field of Search ..... 220/288, 289, 354, 355, 220/307, 309, 310, 306, 304; 215/318, 324, 327, 252, 352; 113/121 AA; 206/515

[56] References Cited

U.S. PATENT DOCUMENTS

| | | | |
|---|---|---|---|
| 1,930,324 | 10/1933 | Stern | 220/307 |
| 2,117,407 | 5/1938 | Davis | 220/288 |
| 2,723,142 | 11/1955 | Stebbins | 220/358 |
| 3,137,409 | 6/1964 | Davis | 220/306 |
| 3,270,904 | 9/1966 | Foster et al. | 215/318 |
| 3,517,848 | 6/1970 | Kesler et al. | 215/318 |
| 3,690,503 | 9/1972 | Curry | 220/289 |

FOREIGN PATENT DOCUMENTS

| | | | |
|---|---|---|---|
| 487,188 | 11/1953 | Italy | 220/307 |
| 363,401 | 12/1931 | United Kingdom | 220/307 |

*Primary Examiner*—William Price
*Assistant Examiner*—Allan N. Shoap
*Attorney, Agent, or Firm*—Glenn, Lyne, Gibbs & Clark

[57] ABSTRACT

A container is provided and comprises a deformable metallic container body adapted to contain a product therein and having a bottom wall and a side wall which has an a tubular upper portion terminating in an open end and a deformable metallic closure for said container body. The closure has a main body portion adjoined at its outer edge by an annular flange with the flange having a roughly U-shaped cross-sectional configuration defined by a bight with an inner leg portion and an outer leg portion extending from opposite ends of the bight; and, the inner leg portion adjoins the main body portion and the outer leg portion is disposed radially outwardly of the open end and terminates therebeneath. One of the tubular upper portion and the inner leg portion is made of a relatively weak metal and the other of a relatively strong metal; and, at least one protrusion is provided in the strong metal portion and is convex into the weak metal portion with the weak metal portion having a corresponding cap disposed around the protrusion. The closure is adapted to be removed by applying a rotational and lifting force against the outer leg portion causing the protrusion to deform the weaker metal portion by defining a thread-like groove therein due to the rotational and lifting action enabling easy removal of the closure.

12 Claims, 9 Drawing Figures

CONTAINER

BACKGROUND OF THE INVENTION

Containers made of metallic materials, such as thin gauge aluminous materials, are in wide use throughout industry for containing products such as food products. For example, puddings, gelatin, desserts, fruits, and the like are often sold in thin gauge aluminous containers each of which is sized to provide one normal serving and each container is then used as a serving dish whereby a consumer is encouraged to eat directly therefrom using an appropriate eating utensil and/or the consumer is encouraged to drink directly from such container. A problem with many of the thin gauge metallic containers in current use is that the lid or closure provided on each of these containers is difficult to remove without damage to the main container and the leaving of jagged metal edges which are dangerous and can injure a consumer.

SUMMARY

It is a feature of this invention to provide a simple and economical metallic container which is particularly adapted to be made of thin gauge metal, such as thin gauge aluminum alloy, and the container has a simple closure which is installed by commercially available equipment and readily removed without producing jagged metal edges which are likely to injure anyone coming into contact therewith.

Another feature of this invention is the provision of a metal container of the character mentioned which utilizes metal of at least two strengths in a closure and supporting structure therefor and which employs integral means in a portion of the stronger of the metals to deform a corresponding portion in the weaker metal to facilitate removal of the closure.

Another feature of this invention is the provision of a metal container of the character mentioned in which the two strengths of metal are provided by two different metal alloys.

Another feature of this invention is the provision of a metal container of the character mentioned in which the two strengths of metal are provided by the same metal alloy with the weaker of the two being thinner in gauge.

Another feature of this invention is the provision of a container comprising a deformable metallic container body adapted to contain a product therein and having a bottom wall and a side wall which has an upper portion terminating in an open end and a deformable metallic closure for said container body. The closure has a main body portion adjoined at its outer edge by an annular flange with the flange having a roughly U-shaped cross-sectional configuration defined by a bight with an inner leg portion and an outer leg portion extending from opposite ends of the bight; and, the inner leg portion adjoins the main body portion and the outer leg portion is disposed radially outwardly of said open end and terminates therebeneath. One of the said tubular upper portion and the inner leg portion is made of a relatively weak metal and the other of a relatively strong metal; and, at least one protrusion is provided in the strong metal portion and is convex into the weak metal portion with the weak metal portion having a corresponding cap disposed around the protrusion. The closure is adapted to be removed by applying a rotational and lifting force against the outer leg portion causing said protrusion to deform a channel in the weaker metal portion which has the appearance of a thread-like groove and such channel is produced due to the rotational and lifting action enabling easy removal of the closure.

Accordingly, it is an object of this invention to provide a container having one or more of the novel features set forth above or hereinafter shown or described.

Other details, features, objects, uses, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
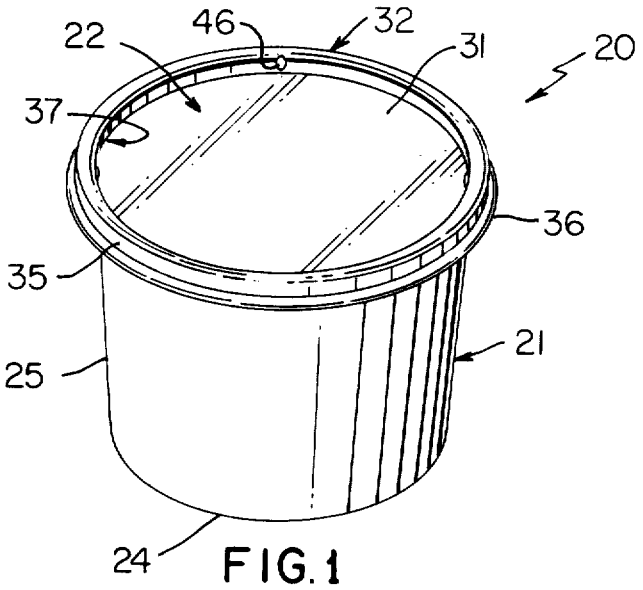
FIG. 1 is a perspective view of an exemplary container of this invention which has an easily removed closure suitably installed thereon and contains a product therewithin.

Reference is now made to FIG. 1 of the drawings which illustrates one exemplary embodiment of a container construction or container of this invention which is designated generally by the reference numeral 20 and the container 20 comprises a deformable metallic container body 21 particularly adapted to contain a product therein and a deformable metallic closure 22 for the container body.

The container 20 may contain any suitable product that is capable of being contained by a thin gauge easily deformable metallic material and examples of thin gauge materials which may be employed will be presented subsequently in this specification; however, the container 20 is particularly adapted to contain a food product 23 such as an individual serving of a dessert such as fruit, pudding, gelatin, or the like whereby the container 20 may have a 5 ounce capacity.

The metallic material used to make the container body 21 is preferably of one strength and the metallic material used to make the closure is of a different strength, as will be explained in more detail later; and, the relative strengths or weaknesses of these two components are utilized to optimum advantage to assure the provision of a thin gauge container which may contain products of the character mentioned and which has a closure which is particularly adapted to be easily removed without the likelihood of producing sharp jagged edges which might injure a consumer or anyone coming into contact therewith.

Figure 2:
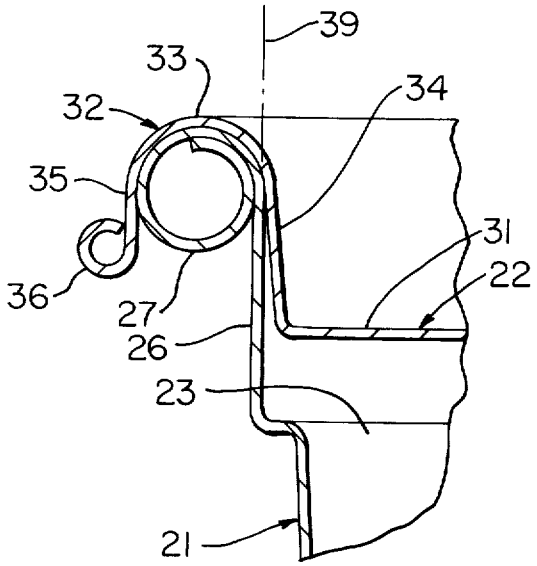
FIG. 2 is an enlarged fragmentary cross-sectional view of an upper portion of the container of FIG. 1 illustrating its closure in position against a first circumferential bead provided in a tubular upper portion of the side wall of the container body prior to simultaneously providing an annular indentation in an inner leg of a flange of the closure and in the tubular upper portion beneath the bead.
Figure 3:
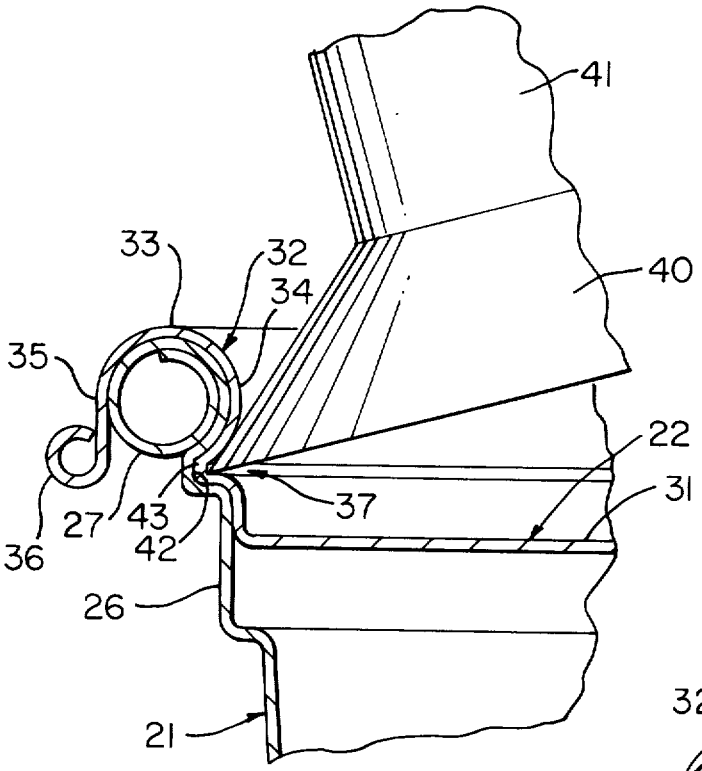
FIG. 3 is an enlarged view similar to FIG. 2 illustrating one technique which may be employed to define the annular indentation in the tubular upper portion and the inner leg of the flange.
Figure 5:
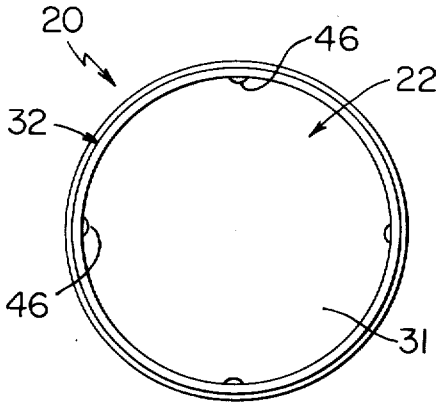
FIG. 5 is a top plan view of the container of FIG. 4 after reversing four 90° portions of the annular indentation.

Referring to FIGS. 1, 2, and 3, it will be seen that the container body 21 has a bottom wall 24, which may be a planar bottom wall, a substantially frustoconical side wall 25 which has a radially outwardly offset upper portion 26 and the upper portion 26 may also be frustoconical and terminates in a first circumferential bead 27. The bead 27 is a substantially tubular toroidal bead extending about the entire periphery of the tubular upper portion 26 and such bead defines an open end for the container body 21.

The readily deformable closure 22 has a main body portion 31 adjoined at its outer edge by an annular flange which is designated generally by the reference numeral 32; and, the flange 32 has a roughly U-shaped cross-sectional configuration and opens downwardly, i.e., from the top of the container 20 toward the bottom of the container, with the U-shaped cross-sectional configuration being defined by an uppermost bight 33 having an inner leg portion 34 and an outer leg portion 35 extending downwardly from opposite ends of the bight 33. The inner leg portion 34 of flange 32 adjoins the main body portion 31 and the outer leg portion 35 terminates in a second circumferential bed 36. The bead 36 is also in the form of a substantially tubular toroidal bead whereby the closure 22 is free of sharp peripheral outer edges.

The outer leg portion 35 of flange 32 is disposed radially outwardly of the open end of the container body 21 and such leg portion has its terminal bead 36 disposed at least in part vertically beneath the open end of the container body and in particular beneath the bead 27.

The container body 21 and thus the tubular upper portion 26 of side wall 25 is made of a relatively strong metal; and the closure 22 with its flange 32 and inner leg portion 34 is made of a relatively weak metal. This reference to strong and weak metals will be discussed in more detail subsequently.

The container 20 has an annular indentation which is designated by the reference numeral 37 in inner leg portion 34 of the flange 32 and the tubular upper portion 26 beneath the bead 27. The annular indentation extends radially outwardly of an imaginary tubular surface shown by dot-dash lines 39 and defined by the interface of the tubular upper portion 26 and inner leg portion 34. The annular indentation 37 may be provided utilizing any suitable means or technique known in the art. For example, a forming roller 40 may be provided and rotatably supported on an associated shaft 41 while being urged by a suitable mechanism (not shown) against the inner leg portion 34 of the flange 32 while backing the outside surface of the tubular upper portion 26 with a suitable backing device or fixture (not shown) whereby such forming roller defines the indentation 37 in the container 20. The annular indentation 37 is in the form of an annular groove 42 of roughly V-shaped cross-sectional configuration extending in the tubular upper portion 26 and a corresponding annular V-shaped projection 43 is provided on the inner leg portion 34 so that the annular projection 43 extends within the annular groove 42. It will be appreciated that the annular groove 42 is concave inwardly toward the center of the container 20 and thus toward the center of the closure 22 and that the annular projection 43 extends outwardly from leg 34 with its convex portion toward leg 35.

Figure 6:
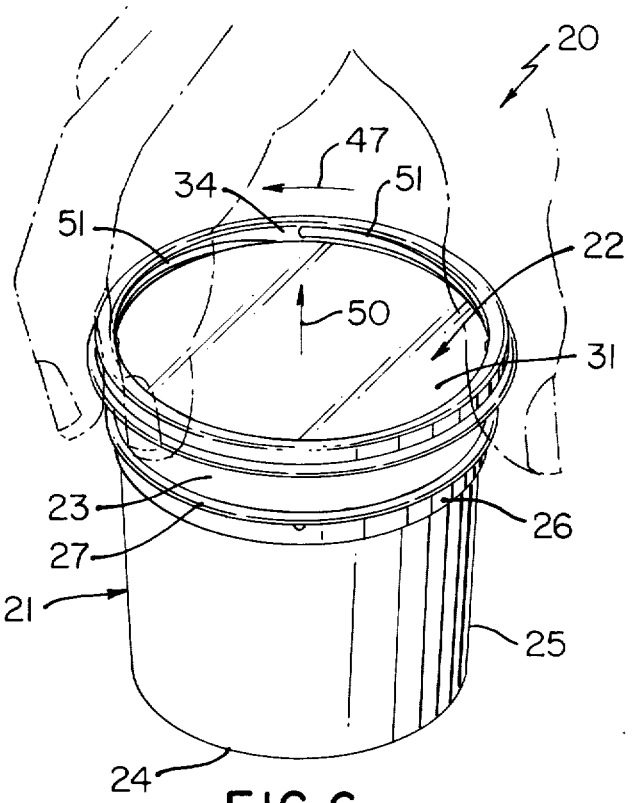
FIG. 6 is a view illustrating the manner in which the closure of the container of FIG. 1 may be removed by applying a rotational and lifting force against the outer leg portion of the peripheral flange of the closure.

The container 20 has at least one protrusion 45 in the strong metal of upper portion 26 and protrusion 45 is convex into the weak metal of inner leg portion 34 with the weak metal of leg portion 34 having a corresponding cap 46 disposed around the protrusion 45. The closure 22 is adpated to be removed by the simultaneous application of rotational force shown by arrow 47 and a substantially vertical lifting force shown by arrow 50 against the outer leg portion causing each protrusion 45 to deform the weaker metal of leg portion or leg 34 and define a thread-like groove therein and the convex metal portion of each groove is shown in FIG. 6 and designated by the reference numeral 51. Each groove 51 is defined due to the rotational and lifting action enabling easy removal of the closure 22.

The exemplary container 20 of FIGS. 1-6 has at least another protrusion 45 and preferably three additional protrusions 45 in the strong metal upper portion 26 and all protrusions 45 are convex into the weak metal of leg portion 34 while the weak metal leg portion 34 has three corresponding caps 46 disposed around the three additional protrusions 45. Thus, it will be seen that container 20 has a total of four protrusions 45 defined in the upper portion 26 and a corresponding four caps 46 are disposed around or cover protrusions 45. The four protrusions 45 are disposed roughly 90° apart whereby the closure 22 is adapted to be removed by simultaneously applying a rotational force 47 through an angle of roughly 90° and a lifting force 50.

Figure 4:
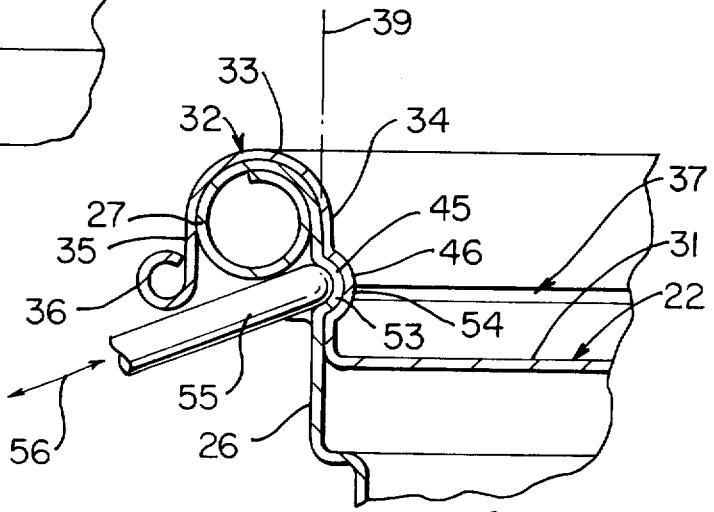
FIG. 4 is a view similar to FIG. 3 illustrating a technique for reversing a portion of the annular indentation as defined in FIG. 3 with a forming pin to define a protrusion in the tubular upper portion and a corresponding cap thereover defined from the inner leg of the flange.

Each protrusion 45 is defined by a protrusion-forming portion 53 of the annular indentation 37 in the tubular upper portion 26 and as best seen in FIG. 4 is entirely disposed radially inwardly of the imaginary tubular surface 39 and each protrusion 45 is convex toward the center of the closure 22. Similarly, each cap 46 which is disposed around and surrounds a corresponding protrusion 45 is defined by a cap-forming portion 54 of the annular indentation 37 in the inner leg portion 34 and each cap 54 is disposed inwardly of its associated protrusion 45 while also being convex toward the center of the closure 22.

It will be appreciated that any desired number of protrusions 45 and corresponding caps 46 may be simultaneously defined in the container 20 and the amount of angular rotation required for the closure 22 during lifting thereof will be determined by the number of protrusions 45 and their angular spacing. For example, if one protrusion 45 were to be provided, the closure 22 would be rotated approximately 360°; if two protrusions 45 were to be provided and spaced roughly 180° apart, the closure 22 would be rotated roughly 180° for removal; if three protrusions 45 were to be provided and spaced roughly 120° apart, the closure 22 would be rotated roughly 120° for removal; and if six protrusions 45 were to be provided and spaced roughly 60° apart, the closure 22 would be rotated roughly 60° for removal.

Each associated protrusion 45 and cap 46 is formed in a simultaneous manner by a forming pin 55 as illustrated in FIG. 4 and the forming pin 55 is moved by a suitable mechanism which is designated schematically by the double arrow 56 into engagement with the tubular portion 26 to defined a protrusion 45 and its corresponding cap 46. It will be appreciated that the four protrusions 45 and caps 46 may be defined in a simultaneous manner, if desired. The forming pin 55 may utilize suitable back-up tool or fixture (not shown) to assure proper forming and each protrusion 45 and cap 46 has a roughly hemispherical configuration which is convex inwardly toward the center of the container 20 and closure 22.

Figure 7:
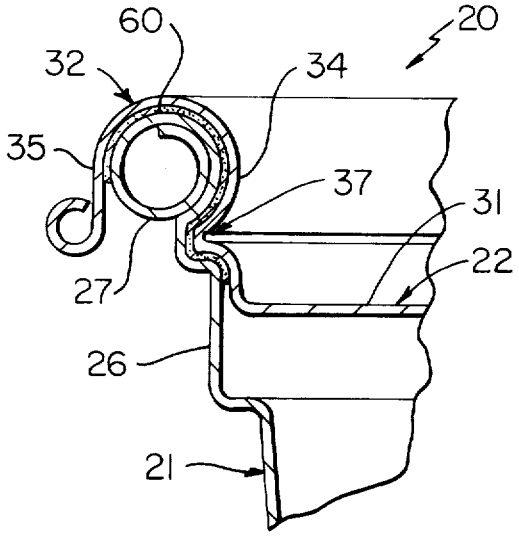
FIG. 7 is a view similar to FIG. 3 minus the forming roller and also showing a seaming compound at the interface of the closure and tubular upper portion of the container body.

Having described the container 20 in detail, reference is now made to FIG. 7 of the drawings which illustrates a modified container which is identical to container 20 except that it uses a seaming compound 60 at the interface of the tubular upper portion 26 and inner leg portion 34 of flange 32. The container 20 of FIG. 7 is used primarily for refrigerated and shelf-stable products; if a hermetic seal is required then the seaming compound is such that it does not adhere in a tenacious manner to its adjoining components and allows the closure 22 to be easily twisted off in the manner previously described by applying forces 47 and 50. One example of a suitable seaming compound which may be employed is sold by chemical companies such as Watson Coating Company, etc.

Figure 8:
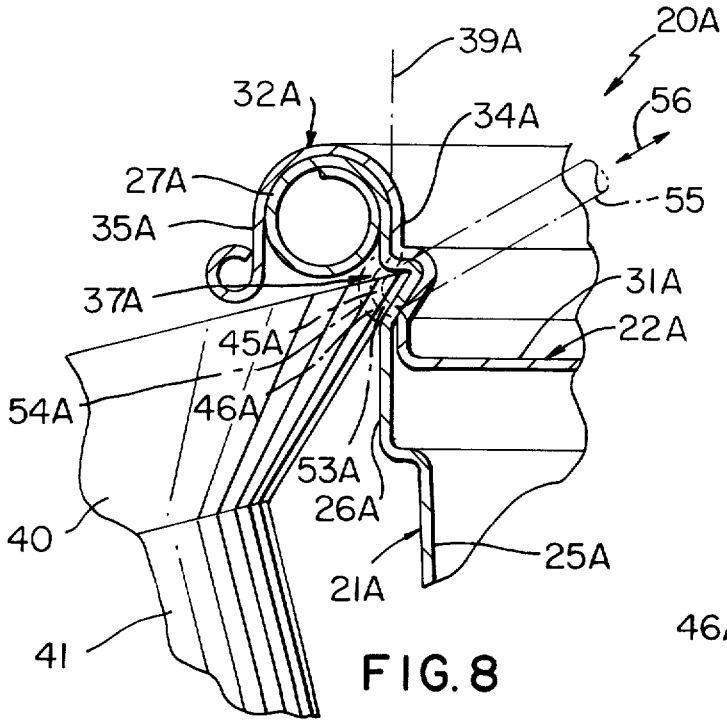
FIG. 8 is a view similar to FIG. 3 illustrating a modification of the container of this invention.
Figure 9:
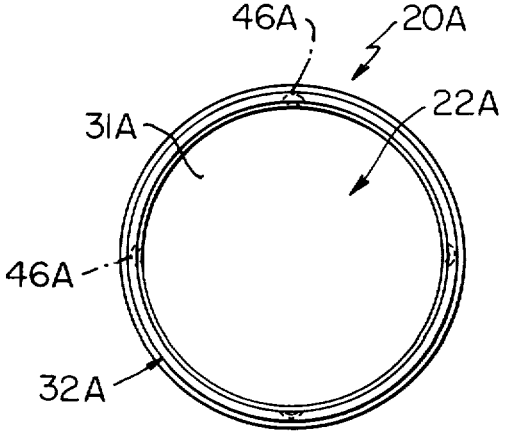
FIG. 9 is a top plan view similar to FIG. 5 of the container of FIG. 8.

Other exemplary embodiments of this invention are illustrated in FIGS. 8 and 9. The container illustrated in FIGS. 8 and 9 is similar to the container 20; therefore, such container will be designated by the reference numerals 20A and components parts of container 20A which are similar to corresponding parts of container 20 will be designated in the drawings by the same reference numeral as in the container 20 (whether or not such parts are mentioned in the specification) followed by the letter designation A and not described again in detail. The tools used to form certain component parts of container 20A will be given the same reference numerals as in the container 20 and not described again.

The main differences between the container 20A and the container 20 are first that the container body 21A is made of comparatively weak metal and the closure 22A of comparatively strong metal; and, the annular indentation 37A and protrusions 45A and caps 46A extend in an opposite direction or sense from the direction in which these components extend in container 20.

In particular the container 20A with its side wall 25A and tubular upper portion 26A is made of weak metal while the closure 22A with its flange 32A including inner leg portion 34A is made of strong metal. The annular indentation 37A in the inner leg portion 34A of flange 32A and in tubular upper portion 26A is disposed beneath the bead 27A; and the annular indentation extends radially inwardly of the imaginary tubular surface 39A defined by the interface of the tubular upper portion 26A and inner leg portion 34A. Each protrusion 45A is defined by protrusion-forming portion 53A of the annular indentation 37A in the inner leg portion and is entirely disposed radially outwardly of the imaginary tubular surface 39A and convex away from the center of the closure. Each cap 46A is defined by a cap-forming portion 54A of the annular indentation 37A in the tubular upper portion and the cap 46A is disposed radially outwardly of its protrusion 45A and is also convex away from the center of the closure 22A.

Reference has been made previously to the fact that the container of this invention uses metal of two strengths provided by two different metal alloys. An example of this would be to provide the container body 21 with its tubular upper portion 26 of 5050 H-19 aluminum alloy 0.0075 inch thick and the closure 22 with its flange 32 and inner leg 34 of 3003 H-14 aluminum alloy 0.006 inch thick.

Reference has also been made previously to the provision of a metal container which uses metal of two strengths provided by the same metal alloy with the weaker of the two being thinner in gauge. An example of this for the container 20 would be to make the entire container body 21 of 5050 H-19 aluminum alloy with a metal thickness of 0.0075 inch and the closure of the same alloy 0.006 inch thick. It will be appreciated that the dimensions given above are typical nominal dimensions.

Certain typical examples of materials which may be used to make the container of this invention have been given above; however, any suitable metallic material may be used to make the container of this invention.

Reference has been made in this disclosure to the provision of a container of roughly 5 ounce size for desserts, or the like. However, it is to be understood that the container of this invention may be as small as a fraction of an ounce or much greater than five ounces and may be used to contain any desired product.

The container body and closure of the container 20 of this invention is preferably coated on its inside and outside surfaces with a suitable protective coating which may be a modified vinyl base coating such as a modified polyvinyl chloride. For example, in one application of this invention where five ounce containers were used to contain desserts a polyvinyl chloride coating of 8.5 milligram per square inch was provided on the inside surface of the container body and closure and a 2 milligram per square inch coating was provided on the outside surface of these components. It will also be appreciated that the coating on the inside and outside surfaces may be any suitable thermoset coating, or the like.

While present embodiments of this invention, and methods of practicing the same, have been illustrated and described, it will be recognized that this invention may be otherwise variously embodied and practiced within the scope of the following claims.

What is claimed is:

1. A container comprising, a deformable metallic container body adapted to contain a product therein and having a bottom wall and a side wall which has a tubular upper portion terminating in an open end, a deformable metallic closure for said container body, said closure having a main body adjoined at its outer edge by an annular flange, said flange having a roughly U-shaped cross-sectional configuration defined by a bight with an inner leg portion and an outer leg extending from opposite ends of said bight, said inner leg portion adjoining said main body and said outer leg being disposed radially outwardly of said open end and terminating therebeneath, said tubular upper portion and said inner leg portion each being provided with an annular indentation to effect a seam between said tubular upper portion and said inner leg portion, one of said tubular upper portion and said inner leg portion being made of metal the other which is stronger than the metal of the other, and at least one punch-like protrusion in said-one portion which is convex into said other portion with said other portion having a corresponding cap disposed around said protrusion, said closure being adapted to be removed by applying a rotational and lifting force against said outer leg causing said punch-like protrusion to deform said other portion by defining a thread-like groove therein due to the rotational and lifting action enabling easy removal of said closure.

2. A container as set forth in claim 1 in which said side wall with its tubular upper portion is made of said metal which is stronger.

3. A container as set forth in claim 1 in which said inner leg portion is made of said metal which is stronger.

4. A container as set forth in claim 1 and further comprising a first circumferential bead provided on said tubular upper portion and defining said open end in said container body and a second circumferential bead defining the terminal edge of said outer leg.

5. A container as set forth in claim 4 in which each of said circumferential beads is a substantially tubular toroidal bead.

6. A container as set forth in claim 1 in which said side wall with its tubular upper portion is made of said metal which is stronger and said annular indentation in said inner leg portion of said flange is seamed to said tubular upper portion beneath said open end, said annular indentation extending radially outwardly of a tubular interface of said tubular upper portion and inner leg portion, said punch-like protrusion being defined of a protrusion-forming portion of the annular indentation in said tubular upper portion and being entirely disposed radially inwardly of said tubular interface and convex toward the center of said closure, and said cap being defined of a cap-forming portion of the annular indentation in said inner leg portion and said cap being disposed radially inwardly of said punch-like protrusion and convex toward the center of said closure.

7. A container as set forth in claim 1 in which said metal inner leg portion is made of said metal which is stronger and said annular indentation in said inner leg portion of said flange is seamed to said tubular upper portion beneath said open end, said annular indentation extending radially inwardly of a tubular interface of said tubular upper portion and inner leg portion, said punch-like protrusion being defined of a protrusion-forming portion of the annular indentation in said inner leg portion and being entirely disposed radially outwardly of said tubular interface and convex away from the center of said closure, and said cap being defined of a cap-forming portion of the annular indentation in said tubular upper portion and said cap being disposed radially outwardly of said punch-like protrusion and convex away from the center of said closure.

8. A container as set forth in claim 1 and further comprising at least another protrusion in said one portion, said other protrusion also being convex into said other portion with said other portion also having another corresponding cap disposed around the other protrusion, said protrusions being disposed roughly 180° apart whereby said closure is adapted to be removed by rotation through roughly 180° while lifting upwardly thereagainst.

9. A container as set forth in claim 1 and further comprising three additional protrusions in said one portion which together with said one protrusion define a total of four protrusions, said three protrusions also being convex into said other portion with said other portion also having three corresponding caps disposed around the three protrusions, said four protrusions being disposed roughly 90° apart whereby said closure is adapted to be removed by rotation through roughly 90° while lifting upwardly thereagainst.

10. A container as set forth in claim 1 in which said tubular upper portion and said inner leg portion have a tubular interface therebetween and further comprising a seaming compound disposed between said tubular upper portion and inner leg portion at said interface.

11. A nestable container comprising, a deformable metallic container body adapted to contain a product therein and having a bottom wall and frustoconical side wall which has a tubular upper portion terminating in an open end, a deformable metallic closure for said container body, said closure having a main body adjoined at its outer edge by an annular flange, said flange having a roughly U-shaped cross-sectional configuration defined by a bight with an inner leg portion and an outer leg extending from opposite ends of said bight, said inner leg portion adjoining said main body and said outer leg being disposed radially outwardly of said open end and terminating therebeneath, said tubular upper portion and said inner leg portion each being provided with an annular indentation to effect a seam between said tubular upper portion and said inner leg portion, one of said tubular upper portion and said inner leg portion being made of metal which is stronger than the metal of the other, and at least one punch-like protrusion in said one portion which is convex into said other portion with said other portion having a corresponding can disposed around said punch-like protrusion, said closure being adapted to be removed by applying a rotational and lifting force against said outer leg causing said punch-like protrusion to deform said other metal portion by defining a thread-like groove therein due to the rotational and lifting action enabling easy removal of said closure.

12. A container as set forth in claim 11 in which said tubular upper portion is frustoconical.

* * * * *